United States Patent [19]

Krenz

[11] 4,422,700

[45] Dec. 27, 1983

[54] GROUNDED MULTI-PIN CONNECTOR FOR SHIELDED FLAT CABLE

[75] Inventor: Horst M. Krenz, St. Joseph, Mich.

[73] Assignee: Heath Company, St. Joseph, Mich.

[21] Appl. No.: 337,360

[22] Filed: Jan. 6, 1982

[51] Int. Cl.[3] ..... H01R 4/66

[52] U.S. Cl. ..... 339/14 R; 339/176 MF; 339/126 R

[58] Field of Search ..... 339/143, 14 R, 14 P, 339/176 MF, 17 F, 126

[56] References Cited

U.S. PATENT DOCUMENTS

| | | | |
|---|---|---|---|
| 2,169,962 | 8/1939 | Del Camp | 339/143 R |
| 3,059,211 | 10/1962 | Thomas et al. | 339/126 R |
| 3,337,834 | 8/1967 | Godwin et al. | 339/143 R X |
| 3,573,704 | 4/1971 | Tarver | 339/14 R |
| 3,743,925 | 7/1973 | Bossi | 339/143 R X |
| 3,838,380 | 9/1974 | Stieler | 339/126 R |
| 4,130,334 | 12/1978 | Anderson | 339/14 R X |
| 4,345,811 | 8/1982 | Volka | 339/17 F |

*Primary Examiner*—Eugene F. Desmond
*Assistant Examiner*—David L. Pirlot

[57] ABSTRACT

Disclosed is a multi-pin connector for grounding a shielded flat cable enclosed in an insulator. A first conducting element is positioned between and in contact with the receptacle portion of the connector and a grounded portion of the panel through which the connector passes via an aperture thereon. The first conducting element includes a first flat extension which projects away from the panel on a first side thereof and which is folded around a first segment of the flat cable so as to be in contact with and ground the electrical shield of the first cable segment. A second flat extension of the first conducting element projects through the aperture and grounds a second conducting element which is coupled to the plug portion of the connector by means of a cable positioning slot therein through which a second segment of the cable and the second conducting element pass. The second conducting element includes a first flat extension which is folded around the flat cable in contact with the cable shield which is effectively grounded when the connection is made. The second conducting element also includes a distally positioned second flat extension which includes a plurality of short, sharp projections, or teeth, thereon for securely engaging the insulator when the second flat extension is folded around the second cable segment thus enhancing cable connection wear and stress resistance.

14 Claims, 5 Drawing Figures

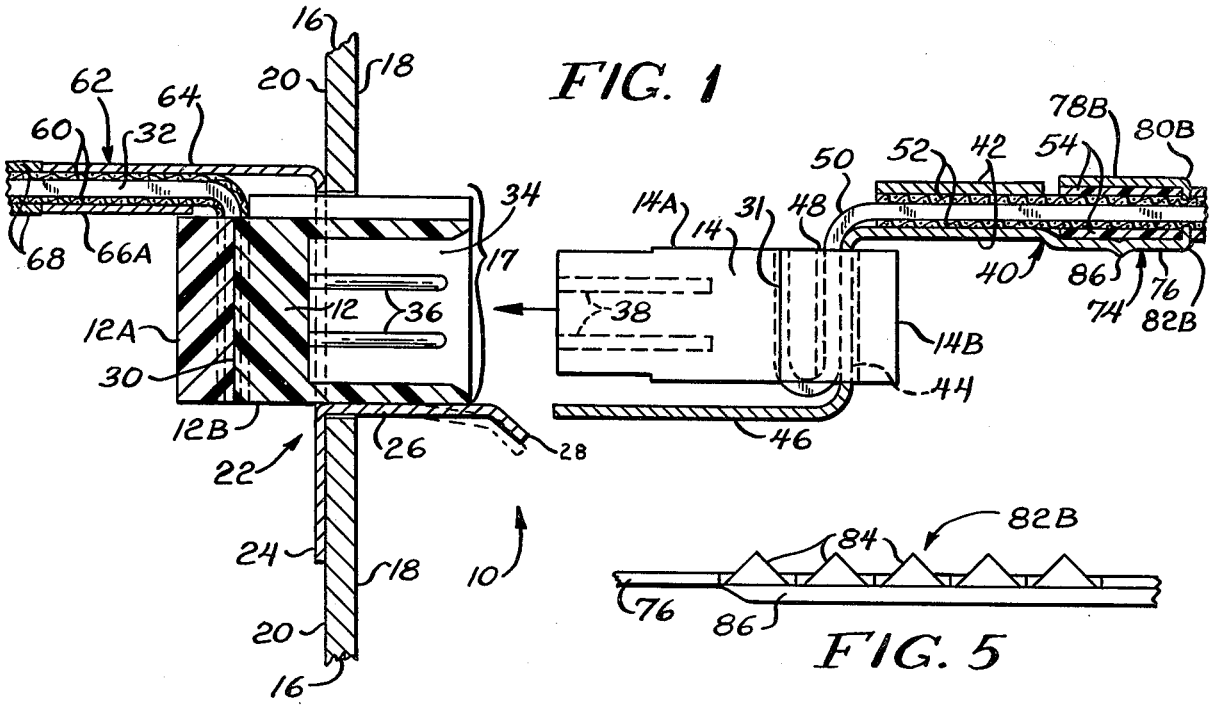
FIG. 1
FIG. 5
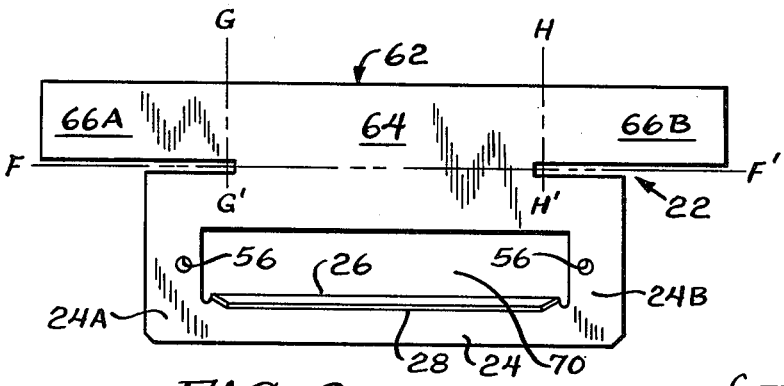
FIG. 2
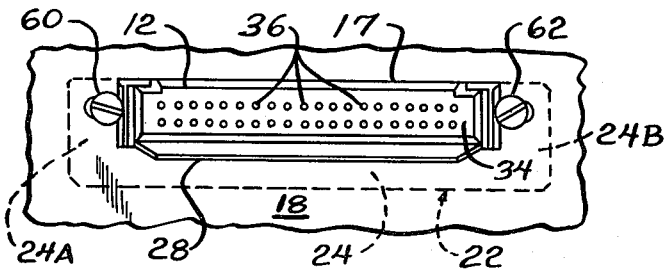
FIG. 3
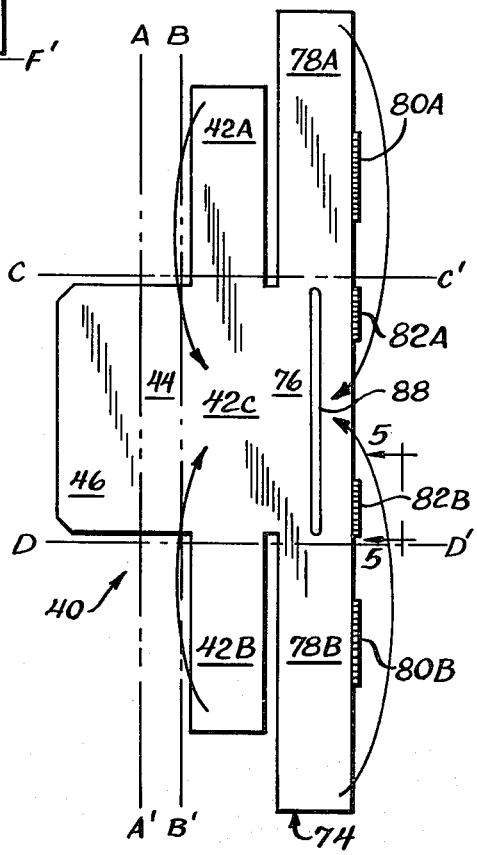
FIG. 4

GROUNDED MULTI-PIN CONNECTOR FOR SHIELDED FLAT CABLE

RELATED APPLICATION

The present invention is related to my co-pending U.S. patent application Ser. No. 282,634, now U.S. Pat. No. 4,381,129 entitled "GROUNDED, MULTI-PIN CONNECTOR FOR SHIELDED FLAT CABLE", filed July 13, 1981, and assigned to the assignee of the present application, the disclosure of which is expressly incorporated herein by reference.

BACKGROUND OF THE INVENTION

This invention generally relates to multi-pin, flat cable connectors and more specifically is directed to an improved multi-pin connector for grounding a flat shielded conductor.

Radio frequency (RF) energy is, in general, an alternating-current energy at any frequency in the radio spectrum between approximately 10 KHZ and $3\times10^8$ MHZ. The higher frequencies are used increasingly primarily because of the availability of smaller components and the requirement for increased signal information rates. This is particularly true in information processing systems where large amounts of information are carried by high frequency signals which are then processed by densely packed, sub-miniature logic circuitry. These high frequency signals tend to escape from their medium of transmission and interfere with surrounding electronic components and conductors. This phenomenon is termed RF interference, the effects of which may vary from rendering electronic equipment totally unusable to periodic performance inaccuracies in high speed signal processing equipment.

RF interference is particularly troublesome in an information processing system such as a word processor. In a typical word processor pulsed signals at 5–10 MHZ are used to drive various sub-systems including several levels of logic circuitry and video display electron beam drive circuitry. These high frequency pulsed signals have extremely rapid rise rates and generate harmonics which interfere particularly with the VHF reception band of nearby television receivers at 54–60 MHZ. In addition, the picture carrier signal in a conventional television receiver operates at 55.25 MHZ which is also subject to RF interference as evidenced by the commonly observed "herringbone" effect on the television receiver's video display.

The degrading effects of RF interference on a television receiver can be partially alleviated through the use of coaxial and twin lead antenna conductors. But this only reduces the effects of RF interference without completely eliminating them since the antenna itself is still susceptible to receiving interfering signal inputs. In particular, a television receiver employing a rabbit ears-type of antenna installation remains highly susceptible to RF interference.

To reduce the effects of RF interference on television receivers and other high frequency electronic devices, conductors carrying these potentially interfering signals have been increasingly enclosed in conductive shields. By coupling these grounded shields to neutral ground potential, RF signals are effectively confined therein and directed to ground. In addition, electronic apparatus in which the high frequency signals are processed are frequently provided with an internal grounded surface for reducing the propagation for high frequency signals therefrom. There remains, however, a potential source of RF signal leakage from these systems and that is at the interface between the external conductor and the grounded enclosure of the electronic device. Prior art devices have frequently coupled a single grounded pin in a multi-pin conductor to the shield for grounding purposes. But this method of grounding has suffered from limitations primarily because of the limited area of electrical contact employed therein. Similarly, prior art devices have been directed toward grounding the shield of the conductor outside of the electronic apparatus while providing no ground, or inadequate grounding at best, for conductors within the electronic apparatus.

Generally, prior art attempts to improve conductor shield grounding have made the electrical connectors associated therewith more complex and the related connections more difficult to make and break. This is particularly undesirable with respect to a growing portion of current electronic devices which are increasingly designed to interface and operate with a wide variety of associated electronic equipment. Thus, the need for a universal-type of grounded electrical connector is readily apparent. The present invention is intended to overcome the aforementioned problems by providing an effective ground coupler for the shields of external and internal conductors connected to the panel of an electronic device.

OBJECTS OF THE INVENTION

Accordingly, it is an object of the present invention to provide an improved multi-pin connector for grounding a shielded, flat cable.

It is another object of the present invention to provide an improved multi-pin connector for reducing the RF interference produced by a flat conducting cable.

Still another object of the present invention is to provide an improved grounded connector to which many existing multi-pin, flat cable connectors may be easily adapted.

A further object of the present invention is to provide a connector with improved grounding characteristics for grounding the conductive shield of a multi-conductor flat cable.

A still further object of the present invention is to provide an improved multi-pin electrical connector for coupling two segments of a shielded, flat cable and for providing an effective ground connection for the shield of each segment in reducing RF leakage therefrom.

Another object of the present invention is to provide a multi-pin electrical connector mounted in an aperture of a grounded partition for passing a shielded, flat cable through the partition and for coupling the cable's shield to the grounded partition.

Still another object of the present invention is to provide a ruggedized multi-pin electrical connector for a flat cable offering improved cable coupling and retention while facilitating electrical connection and disconnection.

BRIEF DESCRIPTION OF THE DRAWINGS

The appended claims set forth those novel features believed characteristic of the invention. However, the invention itself as well as further objects and advantages thereof will best be understood by reference to the following detailed description of a preferred embodiment taken in conjunction with the accompanying drawings, where like reference characters identify like elements throughout the various figures, in which:

FIG. 1 is a partially cutaway cross sectional view of the panel-mounted receptacle and plug portions of a grounded, multi-pin connector in accordance with the present invention;

FIG. 2 shows the generally planar configuration of the grounded element of the multi-pin connector prior to its re-shaping for insertion in and mounting on the receptacle portion of the grounded, multi-pin connector wherein the axes along which the grounded element is folded are indicated;

FIG. 3 is a front view of the receptacle portion of the multi-pin connector positioned in the aperture of a panel wherein is also positioned a grounded element in accordance with the present invention;

FIG. 4 shows the planar configuration of the ground coupler element prior to its re-shaping for insertion in and mounting on the plug portion of the grounded, multi-pin connector wherein the axes along which the ground coupler element is folded are indicated; and FIG. 5 shows an edge view of the grounded element of FIG. 3 taken along line 5—5.

DESCRIPTION OF THE PREFERRED EMBODIMENT

Referring to FIG. 1, there is shown an improved grounded, multi-pin connector 10 for a shielded flat cable in accordance with the present invention. Grounded element 22 is mounted in combination with receptacle 12 to panel 16 so as to be in electrical contact with the grounded surface 20 of the panel 16. Receptacle 12 and grounded element 22 project through aperture 17 in panel 16. Plug portion 14 is coupled to receptacle portion 12 in assembling multi-pin connector 10. Plug portion 14 is provided with ground coupler 40, the contact portion 42 which is in electrical contact with conductive shield 52 of plug-mounted conductor 50. When the receptacle and plug portions 12 and 14 of the multi-pin connector 10 are mated, electrical contact is established between blade contact 46 of ground coupler 40 and projecting shelf 26 of grounded element 22 thus grounding the conductive shield 52 of plug-mounted conductor 50.

Receptacle portion 12 of the multi-pin connector 10 is mounted in a conventional manner to panel 16. Receptacle 12 is comprised of a first section **12*a* and a second section 12*b* which are connected along groove 30 which defines their area of joinder. Conductor 32 is positioned between first and second receptacle sections 12*a* and 12*b* during the assembly process with metal contacts (not shown) located therein for piercing the insulation of conductor 32 in establishing electrical contact between conducting pins 36 of receptacle 12 and conductor 32. Receptacle 12 includes a cavity 34 formed in its forward section in which are positioned conducting pins 36** in a fixed planar array.

Receptacle 12 is mounted to panel 16 so as to project through an aperture 17 located therein. Panel 16 typically forms one enclosing surface of an electronic device and includes an outer surface 18 which is generally painted and an inner surface 20 which is unpainted. In addition, inner surface 20 is maintained at neutral ground potential.

Mounted to panel 16 in combination with receptacle 16 is grounded element 22. Referring to FIG. 2, there is shown grounded element 22 having a base 24 and lateral sections **24*a* and 24*b* which, in combination, define a channel in grounded element 22 in which receptacle 12 is positioned when inserted in aperture 17. Grounded element base 24 is positioned beneath receptacle 12 while lateral sections 24*a* and 24*b* are located on each side of receptacle 12 when mounted in aperture 17. Grounded element 22, which is preferably comprised of a somewhat flexible, conductive, metallic material, is provided with apertures 56 and 58 in lateral sections 24*a* and 24*b*. It is through apertures 56 and 58 in grounded element 22 that conventional mounting means may be inserted when grounded element 22 is properly aligned on panel 16 with respect to aperture 17 therein. Corresponding holes (not shown) are also provided in connector receptacle 12 and panel 16 through which conventional mounting means may be inserted when aligned with the respective mounting apertures 56 and 58 of grounded element 22**.

The mounting of connector receptacle 12 in the aperture 17 of panel 16 is shown in FIG. 3. Securing means 60 and 62, which are shown in FIG. 3 as threaded screws or small bolts, are positioned, from front to back, through panel 18, grounded element 22 (shown in dotted outline form), and connector receptacle 12. Connector receptacle 12 includes a hollowed-out, or cavity, portion 34 on its front surface in which are located a plurality of rigid conducting pins 36 arranged in a fixed planar array. Conducting pins 36 extend through connector receptacle 12 to approximately where sections **12*a* and 12*b* of receptacle 12 meet along the plane defined by line 30. Thus, when sections 12*a* and 12*b* are properly assembled, electrical contact is established between pins 36 and the conductors of the receptacle-mounted flat cable 32**.

Also included in grounded element 22 is projecting shelf 26 which projects from grounded element base 24 through aperture 17 when grounded element 22 is properly mounted on panel 16. The spacing of connector receptacle 12 and projecting shelf 26 of grounded element 22 is such that when connector receptacle 12 is positioned in aperture 17 one of its lateral surfaces is in close proximity to the flat portion of projecting shelf 26. In the preferred embodiment of the present invention, projecting shelf 26 is in contact with the lower lateral surface of connector receptacle 12 such that another conducting element may be positioned therebetween by virtue of the flexible character of grounded element 22, as will be presently explained. The flexibility of grounded element 22, and in particular the projecting shelf 26 thereof, is shown in FIG. 1 in dotted-line form which indicates that projecting shelf 26 may be displaced away from the lateral surface of receptacle 12 which it is positioned adjacent to, or in contact with. Projecting shelf 26 includes a forward edge 28 which is directed away from connector receptacle 12 when both are properly positioned in aperture 17 of panel 16. This forward edge 28 of projecting shelf 26 facilitates the insertion of a thin object between projecting shelf 26 and the adjacent lateral surface of connector receptacle 12.

Referring to FIGS. 1 and 2, there is shown the cable shield grounding sleeve 62 of grounded element 22. Grounding sleeve 62 includes lateral sections 66A, 66B and a center section 64 which adjoins and is continuous with the remaining portion of grounded element 22. Grounded element 22 is installed in combination with receptacle 12 and flat cable 32 in the following manner. Receptacle 12 is inserted through the aperture 70 of grounded element 22. Grounded element 22 is then bent along line F—F', as shown in FIG. 2, to form the grounding sleeve 62 of grounded element 22. While FIG. 1 shows grounding sleeve 62 forming an angle of approximately 90° with the remaining portion of grounded element 22, the present invention is not limited to this configuration and grounding sleeve 62 may form virtually any angle with grounded element base 24.

With flat cable 32 securely positioned within receptacle 12 and with its outer insulation 68 removed from that portion of flat cable 32 immediately adjacent receptacle 12, the section 64 of the cable shield grounding sleeve 62 is placed in electrical contact with the conductive shield 60 of the flat cable when grounded element 22 is bent along line F—F'. Cable shield grounding sleeve 62 is then bent along lines G—G' and H—H' to form lateral sections 66A, 66B of cable shield grounding sleeve 62. Thus, with grounded element 22 subjected to the three previously described bending operations, center section 64 and lateral sections 66A, 66B are placed in direct contact with opposite facing sides of the conductive shield 60 of conductor 32. In this manner, conductive shield 60 is directly coupled to the grounded inner surface 20 of panel 16. Thus, RF radiation emanating from conductor 32 is directed to neutral ground potential and RFI from the conductor is substantially reduced.

Although FIG. 1 shows center section 64 in contact with an upper surface of shield 60 and lateral sections 66A, 66B in contact with a lower surface thereof, the present invention is not limited to this configuration. Indeed, the relative positions of center section 64 and lateral sections 66A, 66B may be reversed as they contact shield 60. From FIG. 1, it can also be seen that the conductive shield 60 of flat cable 32 is enclosed in an insulator 68 immediately adjacent the end portion of cable shield grounding sleeve 62. In addition, by forcing center section 64 and lateral sections 66A, 66B in intimate contact with conductive shield 60, the coupling between flat cable 32 and receptacle 12 is strengthened and made more rugged.

The second primary part of grounded, multi-pin connector 10 is plug portion 14. Included in the forward surface of plug 14 are a plurality of conductive recesses 38 which, similar to the conducting pins 36 of receptacle 12, are positioned in a fixed planar array therein. Conducting elements are included in conductive recesses 38 and extend, although not shown in FIG. 1 since this is not a part of the present invention, to the plane defined by line 31. The plane indicated by line 31 defines the area of joinder between the first and second sections 14*a* and 14*b* of plug 14. Plug 14 is assembled by joining first and second sections 14*a* and 14*b* along the plane defined by line 31 in a conventional manner. Plug-mounted conductor 50 is routed through a slot 48 in the second section 14*b* of plug 14 and thence along the bottom portion of second section 14*b*. The end of conductor 50 is then positioned along line 31 such that when first and second plug sections 14*a* and 14*b* are coupled by forcing these sections together along the plane defined by line 31, the conductive elements (not shown) couple the conductive recesses 38 with the conductors of plug-mounted cable 50. The routing of plug-mounted cable 50 through slot 48 and thence to the plane defined by line 31 serves to align the various conductors of cable 50 with the arrayed arrangement of conductive recesses 38 so that electrical contact is established therebetween when first and second sections 14*a* and 14*b* of plug 14 are mated. In addition, the routing of cable 50 through slot 48 provides for strain relief for cable 50 so that receptacle 12 and plug 14 of connector 10 may be de-coupled by pulling plug-mounted cable 50 without disrupting electrical connections in plug portion 14. Slot 48 extends nearly the entire width of the second section 14*b* of plug 14. The configuration of receptacle 12 and plug 14 of grounded, multi-pin connector 10 described thus far is conventional in nature and does not form a part of the present invention.

Surrounding plug-mounted conductor 50 is conductive shield 52. Similar to conductive shield 60, conductive shield 52 is pliable to accommodate the flexibility of the plug-mounted cable 50. In the preferred embodiment of the present invention, conductive shields 52 and 60 are comprised of a copper braid completely surrounding the cables 50 and 32, respectively, so as to reduce RF radiation emanating therefrom. Finally, conductive shields 52, 60 are incorporated in insulative sheaths 54, 68, respectively, for electrical insulating purposes and for maintaining the integrity of and protecting the respective conductive shields. Insulative sheaths 54 and 68 are preferably comprised of neoprene but may also be constructed of any flexible material possessing good insulation characteristics and capable of being formed into a thin sheath-like structure.

Positioned in cable run slot 48 of plug 14 is ground coupler 40. Similar to grounded element 22, ground coupler 40 is preferably comprised of a conductive, metallic material which is semi-rigid in nature for shaping and bending as desired. Ground coupler 40 is comprised of a single piece of material, but may be described in terms of four coupled elements. A contact portion 42 is in electrical contact with conductive shield 52 where insulative sheath 54 has been stripped away therefrom. In a preferred embodiment of the present invention, contact portion 42 is originally a flat surface which is folded so as to completely encompass an end portion of conductive shield 52. A second coupling portion 44 is an extension of the contact portion 42 and is formed by bending ground coupler 40. Ground coupler 40 is then inserted in slot 48 prior to the insertion of plug-mounted cable 50 therein. By again bending ground coupler 40 in a direction opposite to that in which contact portion 42 extends, a blade contact portion 46 is formed which is positioned on the opposite side of plug 14 from that on which contact portion 42 is located. Ground coupler 40 finally includes a cable coupling portion 74 which is adapted to firmly engage the outer insulative sheath 54 of cable 50.

Referring to FIG. 4 the configuration and formation of ground coupler 40 will now be described in detail. As previously stated, ground coupler 40 is initially a flat, single piece of conductive metal capable of being shaped and bent as desired. It is comprised primarily of contact portion 42, coupling portion 44, blade contact 46 and cable coupling portion 74. By bending ground coupler 40 along the axis A-A' and then, in the opposite direction, along axis B-B', coupling portion 44 is thus formed. Following this reshaping of ground coupler 40, blade contact 46 extends in one direction from one end of coupling portion 44 while contact portion 42 extends in the opposite direction from the other end portion of coupling portion 44. In the preferred embodiment, contact portion 42 and blade contact 46 are generally parallel with respect to one another and form approximately right angles with coupling portion 44. By then bending contact portion 42 along axes C-C' and D-D', contact portion 42 may be formed into three sections: upper sections 42*a* and 42*b* and lower section 42*c*. Upper sections 42*a* and 42*b* are formed by bending ground coupler 40 upward along axes C-C' and D-D' with plug mounted cable 50 positioned in contact with ground coupler 40. This causes upper sections 42*a* and 42*b* to be located in contact with the upper surface of conductive shield 52. It is in this manner that a planar sheet of conductive metal shaped as shown in FIG. 4 and positioned in cable run slot 48 is formed into ground coupler 40 which is in electrical contact with conductive shield 52 while securely mounted in cable run slot 48 of plug 14.

Cable coupling portion 74 is similarly formed by bending lateral sections 78A, 78B upward along axes C-C' and D-D', respectively, with a first surface insulative sheath 54 of cable 50 in contact with the thus formed center section 76 of cable coupling portion 74. Lateral sections 78A, 78B are displaced around respective axes C-C' and D-D' until in contact with a second, opposite surface of insulative sheath 54. In this manner, cable coupling portion 74 is wrapped around so as to enclose cable 50.

Located on edge portions of center and lateral sections 76 and 78A, 78B are center projections 82A, 82B and lateral projections 80A 80B respectively. With lateral sections 78A, 78B displaced with respect to center section 76 as previously described so that these sections are aligned generally parallel to each other, center projections 82A, 82B and lateral projections 80A, 80B are positioned in engaging contact with opposite outer surfaces of insulative sheath 54. Thus, cable coupling portion 74 is fixedly coupled to cable 50 reducing the possibility of electrical disengagement between plug 14 and cable 50 due to its displacement as caused by pulling on a distal portion thereof.

The details of the center and lateral projections are shown in FIG. 5 which is an end view of ground coupler 40 taken along line 5—5 in FIG. 4. Presented in FIG. 5 is a side view of center projection 82B which includes a plurality of teeth 84 extending therefrom allowing the cable coupling segment 74 of ground coupler 40 to firmly engage the insulative sheath 54 of cable 50. Also shown in FIG. 5 is a projection 86 on a lower surface of center section 76 by means of which ground coupler 40 may be grasped for facilitating the coupling and de-coupling of plug 14 and receptacle 12 as well as for rigidizing or stiffening center section 76. Projection 86 is shown in FIG. 4 as a notch 88 which may be formed by any of the more conventional methods such as by stamping.

The plane of blade contact 46 is, in general, parallel to the adjacent lateral surface of plug 14. Thus, when plug 14 is inserted in the recessed portion 34 of receptacle 12, blade contact 46 contacts the forward edge 28 of projecting shelf 26. Further insertion of plug 14 into receptacle 12 results in projecting shelf 26 being deflected downward as shown by the dotted outline thereof in FIG. 1. Blade contact 46 is thus wedged between projecting shelf 26 and the lower lateral surface of plug 14 immediately adjacent projecting shelf 26. Since grounded element 22 is comprised of a flexible material, blade contact 46 is easily inserted and withdrawn from the space between projecting shelf 26 and the immediately adjacent lateral surface of receptacle 12. This wedge-like action not only provides for connector integrity when plug 14 and receptacle 12 are coupled, but also insures good electrical contact between projecting shelf 26 and blade contact 46. Since grounded element base 24 is in electrical contact with the inner, grounded surface 20 of panel 16, projecting shelf 26 is also at ground potential. Consequently, when blade contact 46 is inserted between receptacle 12 and projecting shelf 26 and in close contact therewith, blade contact 46 is also maintained at neutral ground potential as are the other portions of ground coupler 40, i.e., coupling portion 44 and contact portion 42. With contact portion 42 at ground potential and in electrical contct with conductive shield 52, conductive shield 52 is also maintained at neutral ground potential causing RF radiation from cable 50 to also be directed to ground potential. It is in this manner that RF radiation from cable 50 is substantially reduced and electromagnetic interference therefrom essentially eliminated.

There has thus been described a multi-pin connector for grounding a shielded flat cable for effectively minimizing RF radiation emanating from the cable. Resulting RF interference is thus substantially reduced. The grounding assembly of the present invention is compatible with existing, generally available, multi-conductor, flat cables used for interfacing electronic devices.

While particular embodiments of the present invention have been shown and described, it will be apparent to those skilled in the art that changes and modifications may be made therein without departing from the invention and its broader aspects. The aim in the appended claims, therefore, is to cover all such changes and modifications as fall within the true spirit and scope of the invention.

I claim:

1. A grounded multi-pin connector mounted in an aperture in a grounded panel and electrically coupling first and second segments of a multi-conductor, flat cable enclosed in a conductive shield wherein said second segment is enclosed in an insulative sheath, said connector comprising:

a first housing connected to said first cable segment, said first housing including a recessed portion wherein are located a plurality of conductive pins in a fixed planar array;

a second housing with a slot therein and having a plurality of conductive receptacles connected to said second cable segment and arranged in a fixed planar array such that when said second housing is inserted in the recessed portion of said first housing, electrical connection between said first and second cable segments is established;

first conductive means having first, second and third sections;

means for mounting said first conductive means between said first housing and said panel such that the first section of said first conductive means is electrically grounded, the second section thereof extends through said aperture adjacent said first housing, and said third section engages the conductive shield of the first segment of said flat cable thereby grounding said conductive shield; and second conductive means having a bent portion positioned in the slot of said second housing and adapted to securely engage said insulative sheath and electrically communicate with the conductive shield of said second segment, a section of said second conductive means extending in a generally parallel direction to said second housing and in close proximity thereto for contacting the second section of said first conductive means when said first and second housings are mated thereby grounding the conductive shield of the second segment of said flat cable.

2. A grounded multi-pin connector mounted in an aperture in a grounded panel and electrically coupling first and second segments of a multi-conductor, flat cable enclosed in a conductive shield, wherein said second segment is enclosed in an insulative sheath, said connector comprising:

a first housing connected to said first cable segment, said first housing including a recessed portion wherein are located a plurality of conductive pins in a fixed planar array;

a second housing with a slot therein and having a plurality of conductive receptacles connected to said second cable segment and arranged in a fixed planar array such that when said second housing is inserted in the recessed portion of said first housing, electrical connection between said first and second cable segments is established;

first conductive means having first, second and third sections wherein the edge portion of said second section distally located relative to said first section forms an obtuse angle with the remaining portion of said second section and said third section includes a flexible portion permitting said third section to be folded upon itself;

mounting means for fixedly positioning said first conductive means between said first housing and said panel such that the first section of said first conductive means is electrically grounded, with the second section thereof extending through said aperture adjacent said first housing with the angled portion thereof directed away from said first housing, and the third section of said first conductive means folded upon itself so as to electrically communicate with the conductive shield of the first segment of said flat cable whereby said shield is electrically grounded; and second conductive means having a bent portion positioned in the slot of said second housing and including first and second flexible portions for foldably engaging the conductive shield and the insulative sheath of said second cable segment, respectively, a third portion of said second conductive means extending in a generally parallel direction to said second housing and in close proximity thereto for contacting the surface of the second section of said first conductive means facing said first housing when said first and second housings are mated thereby grounding the conductive shield of said second cable segment.

3. A grounded multi-pin connector mounted in an aperture in a panel having a first surface and a grounded second surface and electrically coupling first and second segments of a multi-conductor, flat cable enclosed in a conductive shield, wherein said second segment is enclosed in an insulative sheath, said connector comprising:

a first housing connected to said first cable segment and including a recessed portion on its forward surface wherein are located a plurality of conductive pins in a fixed planar array and in electrical communication with said first cable segment;

a second housing having a plurality of conductive receptacles connected to said second cable segment and arranged in a fixed planar array such that when said second housing is inserted in the recessed portion of said first housing, electrical connection between said first and second cable segments is established, said second housing including a slot through which said second cable segment extends for aligning the conductors of said cable with said receptacles and for cable strain relief;

first conductive means having first, second and third flat sections, said second and third sections extending from opposite sides of said first section and forming generally right angles therewith, said second section including an edge portion distally located relative to said first section and forming an obtuse angle with the remaining portion of said second section and said third section including a flexible portion permitting said third section to be folded upon itself;

mounting means for fixedly positioning said first conductive means between said first housing and said grounded second surface of said panel such that the first section of said first conductive means contacts said grounded second surface, with the second section thereof extending through said aperture adjacent a first lateral surface of said first housing and the edge portion thereof directed away from said first housing, and the third section of said first conductive means folded upon itself so as to electrically communicate with the conductive shield of the first segment of said flat cable whereby said shield is electrically grounded; and second conductive means including first and second flexible portions for foldably engaging the conductive shield and the insulative sheath of said second segment, respectively, a third portion coupled to said first portion and extending through the slot of said second housing, and a fourth portion coupled to said third portion and positioned parallel and in close proximity to a first lateral surface of said second housing such that during the mating of said first and second housings, said second conductive means is directed between the second section of said first conductive means and said first housing by the edge portion of said second section in wedging action thereby contacting said first conductive means in grounding the conductive shield of said second cable segment.

4. A connector according to claim 3 wherein the edge portion of the second section of said first conductive means distally located relative to the first section thereof is directed away from said first housing for guiding the fourth portion of said second conductive means into position during the mating of said first and second housings.

5. A connector according to claim 3 wherein said conductive shield is comprised of copper braid encompassing the first and second segments of said flat cable.

6. A connector according to claim 3 wherein said first housing and said first conductive means include a plurality of apertures through which said mounting means are inserted when said first housing and said first conductive means are mounted on said panel.

7. A connector according to claim 3 wherein said mounting means are inserted through respective openings in said first housing, said first conductive means and said panel, said respective openings being aligned when said first housing and said first conductive means are properly positioned on said panel with respect to the aperture therein.

8. A connector according to claim 3 wherein the first section of said first conductive means includes a cutaway portion through which said first housing is inserted, said cutaway portion surrounding said aperture when said connector is mounted on said panel.

9. A connector according to claim 3 wherein said panel comprises an exterior wall of an electrical apparatus wherein said first surface faces outward and said second surface faces toward the interior of said apparatus.

10. A connector according to claim 3 wherein the third section of said first conducting means includes a center member and first and second lateral members flexibly coupled thereto, and wherein the conductive shield of the first segment of said flat cable is securely engaged by folding said first and second lateral members to a position in close proximity to said center member with said cable positioned therebetween.

11. A connector according to claim 3 wherein the first and second flexible portions of said second conductive means each include a center member and first and second lateral members flexibly coupled thereto, and wherein the conductive shield and the insulative sheath of the second segment of said cable are respectively securely engaged by folding respective first and second lateral members to a position in close proximity to a respective center member with said cable positioned therebetween.

12. A connector according to claim 11 wherein the center and first and second lateral members of the second portion of said second conductive means each include at least one projection thereon for securely engaging said insulative sheath when said lateral members are folded to a position in close proximity to said center member.

13. A connector according to claim 11 wherein said second conductive means further includes a second projection on the outside of the center portion thereof whereby said second conductive means may be firmly gripped for facilitating the connecting and disconnecting of said first and second housings.

14. A connector for electrically and mechanically coupling first and second sections of a multi-conductor flat cable through an aperture of an electrically grounded partition, wherein a conductive sheath encloses said conductors and an insulative sheath encloses said conductive sheath, said connector comprising:

a receptacle coupled to the first section of said cable and including a plurality of first contacts each coupled to a conductor of said first cable section, said receptacle adapted to be mounted on said grounded partition;

a plug coupled to the second section of said cable and including a plurality of second contacts each coupled to a conductor of said second cable section, wherein said first and second cable sections are electrically connected when said receptacle and said plug are mated so as to connect said first and second contacts;

a first conductive element adapted to couple the conductive sheath of said first cable segment to said grounded partition when positioned in said aperture and maintained there by means of said partition-mounted receptacle; and a second conductive element integrated with said plug and adapted to couple the conductive sheath of said second cable segment to said first conductive element in grounding said conductive sheath, said second conductive element including attachment means for securely engaging the insulative sheath of said second cable segment.

* * * * *